United States Patent [19]

Nishida

[11] Patent Number: 4,738,188

[45] Date of Patent: Apr. 19, 1988

[54] ROOM AIR CIRCULATING APPARATUS

[75] Inventor: Takashi Nishida, Kumamoto, Japan

[73] Assignee: Nishida Tekko Corporation, Kumamoto, Japan

[21] Appl. No.: 930,055

[22] Filed: Nov. 12, 1986

Related U.S. Application Data

[63] Continuation of Ser. No. 704,235, Feb. 22, 1985, abandoned.

[30] Foreign Application Priority Data

| | | | |
|---|---|---|---|
| Feb. 25, 1984 | [JP] | Japan | 59-25236[U] |
| Jul. 27, 1984 | [JP] | Japan | 59-158088 |
| Jul. 30, 1984 | [JP] | Japan | 59-117744[U] |
| Aug. 28, 1984 | [JP] | Japan | 59-130266[U] |

[51] Int. Cl.[4] ..... F24F 7/007

[52] U.S. Cl. ..... 98/31.5; 98/30; 98/31.6; 98/34.5

[58] Field of Search ..... 98/31.5, 31.6, 34.5, 98/40.27, 30

[56] References Cited

U.S. PATENT DOCUMENTS

| | | | |
|---|---|---|---|
| 1,858,024 | 5/1932 | Moore | 98/34.5 |
| 2,707,526 | 5/1955 | Gordon | 98/31.5 |
| 3,320,868 | 5/1967 | Apouchtine | 98/40.27 X |
| 4,152,973 | 5/1979 | Peterson | 98/31.5 |
| 4,184,415 | 1/1980 | Nicholson | 98/31.5 |
| 4,255,176 | 3/1981 | Macrow | 98/31.5 X |
| 4,367,636 | 1/1983 | Sakuma et al. | 62/263 X |
| 4,522,255 | 6/1985 | Baker | 98/31.6 X |

FOREIGN PATENT DOCUMENTS

| | | | |
|---|---|---|---|
| 54-154150 | 12/1979 | Japan | 98/31.5 |

*Primary Examiner*—Harold Joyce
*Attorney, Agent, or Firm*—Edwin E. Greigg

[57] ABSTRACT

By joint employment with a package air conditioner presently widely used or various types of stoves, room air can largely circulate without being stagnant near floor or ceiling then present little temperature variation among different parts of a room with pleasant and highly healthy environment zone created and energy saving realized.

14 Claims, 15 Drawing Sheets

ROOM AIR CIRCULATING APPARATUS

This is a continuation of copending application Ser. No. 704,235 filed on Feb. 22, 1985 now abandoned.

BACKGROUND OF THE INVENTION

This invention relates to a package air conditioner which is generally used as an air conditioner for homes and every kind of offices, and it relates to a room air circulating apparatus for compulsorily circulating room air to be a temperature control medium in a room when it is used jointly with a stove filled with fuels such as petroleum and gas.

Conventionally, a package air conditioner, through computerized controls such as a use of IC contributes greatly to improving the quality, whether a hanging type or floor type, is employed by a single circulating route form in which room air is drawn in from a particular level and either heated or cooled through a heat exchange, the heated or cooled air thereafter is directed into a room from a particular level which does not obstruct said air to be drawn in. Moreover, most apparatuses are provided with a thermistor sensor being equipped with an intake gate for controlling room temperature.

Therefore, generally speaking, the above-mentioned package air conditioner is being widely used at present and causes a great variation of temperature in different parts of a room, if it is soley employed for heating or cooling, although there is slight variance due to a setting type of an apparatus and a direction of heated or cooled air to be forced out.

The variation of temperature between the upper and lower level of a room is 10 to 20 degrees Celsius in winter and 5 to 10 degrees even in summer due to a draft effect causing warm air to mass near a ceiling level and cool air to stagnate around the floor where room air remains because of obstacles such as desks, chairs, and counters. These conditions are unfavorable for health as well as unpleasant. Furthermore, temperature to be determined is set higher or lower than necessary for providing pleasant temperature in a dwelling zone, which generates a great loss of energy leading to a rise in running cost.

The problems caused by a conventional package air conditioner (shown by A.C. in a drawing) solely employed for heating and cooling will hereinafter be described specifically based on the results of an experiment conducted by the inventor.

I. In case of heating (specification of a heating apparatus: 9,900 Kcal/h, 25 m'/min)

(1) Floor type and blast air is forced out horizontally.

Referring to FIG. 18 of a temperature distribution diagram, the temperature at the upper level in a room reaches 30° C. or higher, while that of the floor level is approximately 20° C., presenting the large temperature variation. The above-mentioned state results because heated air ascends while cool air descends, wherein air constantly circulates at the higher level than the middle in the room and cool air in the lower level stagnates without flowing. In addition to that, various obstacles in the room typically such as desks and chairs cause the above tendency to grow further in a real case.

(2) Floor type and blast air is forced downward at a 30° angle to a horizontal plane.

Referring to FIG. 19 of a temperature distribution diagram, blast air blown to the floor results in less variation of temperature between the upper and lower levels than the first case (1) due to less air stagnation to raise the temperature of the lower level. On the contrary, referring to FIG. 20 of a temperature distribution diagram at the level 1 meter from the floor, a high temperature zone is partially produced at the center of the room, which moreover is the level of a head when a man sits on a chair. Therefore, blast air at high temperature directly blown gives an unpleasant feeling or blows papers off a desk as well as produces unfavorable conditions for ones health.

(3) Hanging type and blast air is forced horizontally.

Referring to FIG. 21 of a temperature distribution diagram, such large temperature variation as approximately 20° C. between the upper and the lower levels in the room, more particularly the temperature variation is larger than the first example due to a hot air zone at the ceiling and a cold air zone near the floor.

(4) Hanging type and blast air is forced downward at a 50° angle to a horizontal plane.

Referring to FIG. 22 of a temperature distribution diagram, an air current of 0.5 m/sec or higher which gives an unpleasant feeling is generated at the central part of a dwelling zone, about 1.5 m high from the floor.

In the manner as stated above, in case of heating, whether an apparatus is a floor type or a hanging type, the variation of temperature between the upper and the lower levels in the room is so great as to cause a chill near the feet of a person. When blast air is exhaled downward to improve the conditions slightly, a high temperature zone is produced partially, and inevitably problems are generated such as a person in a room to be exposed to hot air with high velocity feels unpleasant as well as the health is impaired.

II. In case of cooling.

(1) Floor type

Compared with FIG. 24A of a temperature distribution diagram at the time of directing the air upward at an angle of 30° and FIG. 24B of a temperature distribution diagram at the time of directing the air horizontally, the latter produces a better effect in uniformalizing room temperature. When the forced air direction is excessively downward, however, cool air stagnates near the floor, thereafter further stagnant air lowers the temperature near the feet of a person even to the unusual extent. In addition to that, extremely cool air is prone to strike a human body, resulting in a further vicious impact on health than a case of heating. It is especially unfavorable for women.

(2) Hanging type.

Referring to FIG. 25 of a plane figure of an object room (R) and a cooling apparatus (A.C.) of a hanging type to be set so that air is forced horizontally, the distribution of room temperature is measured at each cross sections of X—X, Y—Y, and Z—Z with distribution diagrams shown by FIG. 26 A, B and C. In this case, both intake gates of the room air and outwardly directed blast air being located near the ceiling permit high temperature air at the upper level to be cooled by the heat exchange, which results in a draft effect due to the fact that cool air descends naturally. Therefore, the temperature variation in the room is as ideal as approximately 1° C. at any part. The downward direction for the forced air, however, is desirable to promote a cooling effect in a dwelling zone where blast air (cool air) directly hits. Therefore, the temperature variation and a cooling effect in a dwelling zone contradict each other.

In the manner as stated above, in case of cooling, blast air is blown either horizontally or upward to cool from the upper level, which results in a more uniform distribution of room temperature. A disadvantage, however, in respect of health caused by the lower half of a body to be cooled too much, hinders a quick cooling and improvement of a cooling effect in a dwelling zone.

The above-mentioned problem caused by the prior art of heating and cooling are hereinafter summarized:

(a) Temperature variation between the upper and the lower levels in a room is too great, especially in case of heating.

(b) Blast air which is extremely hot or cool directly hits a human body then may give unpleasant feeling and injure health.

(c) Blast air, passing a human body with high velocity, further increases unpleasant feeling and vicious impact on health.

In case of heating by means of a stove which is another heating apparatus, according to partial heating of a room due to heat radiation and natural convention, a whole room is not heated up easily while it is sufficiently warm around a stove.

Although there is another type of a stove for directing warm air into a room such as a warm air heater with a forced blowing system or a fan heater, temperature cannot rise high enough in the corner of a room because of generally insufficient amount of air, which results in inferior distribution of temperature in a room compared with that of said package air conditioner and far from pleasant heating.

SUMMARY OF THE INVENTION

The invention is intended to provide a room air circulating apparatus which can realize pleasant and healthy heating and cooling by means of uniform and suitable room temperature even when it is employed jointly with various types of stoves as well as with said package air conditioner.

A room air circulating apparatus according to this invention to be developed in order to attain the object mentioned above is so constructed as to intake room air and exhaust said intake air into a room, and the room air circulating apparatus comprises a hollow case in a box shape provided with an intake gate for room air at least at a lower end of either an upper end or a lower end of the hollow case, a spout gate provided at an upper part of said hollow case in a box shape for exhausting air to a room, and a fan built in said hollow case in a box shape for drawing in and exhausting air.

A room air circulating apparatus according to this invention which is characterized in the manner mentioned above provides hereinafter different operations.

1. Since a room air circulating apparatus is used jointly with a conventional package air conditioner, cool or heated air to be drawn in and generated through the air conditioner is exhausted as conventionally, while either hot room air stagnating near the ceiling which is higher than an exhaust zone at the time of cooling or cool room air stagnating near the floor which is lower than an intake zone of said package air conditioner at the time of heating can be drawn in positively along a horizontal or nearly a horizontal plane and then be mixed with cool or hot air exhausted from said air conditioner. Hereby, overcooling or overheating of cool or hot air exhausted from the package air conditioner is avoided even when the time passes by. Additionally, room air including hot air at the upper level and cool air at the lower level can largely circulate and flow.

2. In either case of heating or cooling, the angles of exhausting cool or hot air from the package air conditioner and of exhausting room air from the circulating apparatus are set slightly upward from a horizontal plane, so that mixed air is situated at the lever higher than a dwelling zone, resulting in flowing at high velocity. Hot air, being involved, generates lenient return air to be exhausted into this circulating apparatus.

3. In spring and autumn without any necessity of heating or cooling, the circulating apparatus, if used solely, can provide pleasant coolness in accordance with the relations between circulated air and effective temperature.

4. At the time of heating by a stove, combustion gas per se or heated gas ascends to the ceiling and stagnates, causing greater temperature variation than the time of the employment of an air conditioner, this circulating apparatus, if employed additionally, draws in, then exhausts cooled air near the floor, mixing with hot air near the ceiling so that the mixed air can largely circulate in the room.

As it is apparent in the manner as stated above, the invention presents many advantages hereinafter;

(1) The large part of room air to be circulated efficiently and largely gives extremely little temperature variation in a room regardless of a type and form of a main air conditioner so that a pleasant environment zone is created by a uniform and suitable room temperature.

More particularly, it is effective for air conditioning a place with obstacles such as desks, chairs, and counters.

(2) Since an extremely high or low temperature zone is not partially created in a dwelling zone, the space in a room can be optimized.

(3) Cool or warm air to be exhausted from the package conditioner at the time of joint employment does not directly strike a human body, eliminating unpleasant feeling and presenting effectiveness in respect of health. More particularly, it is of advantage for women's health at the time of cooling.

(4) Uniform and suitable room temperature results in saving energy and reduction of running cost.

(5) Even pleasantness can be provided in spring and autumn.

Another object of this invention is to make a thin and small apparatus.

A further object of this invention is to provide suitably humidifying effect at the time of health for more pleasant air conditioning.

Still a further object of this invention is so constructed to be fixed and used by minimizing both the occupancy within effective space and to avoid an unsightly appearance of a room.

Other objects and advantages of the invention will become apparent from the following description.

BRIEF DESCRIPTION OF THE INVENTION

Figure 5:
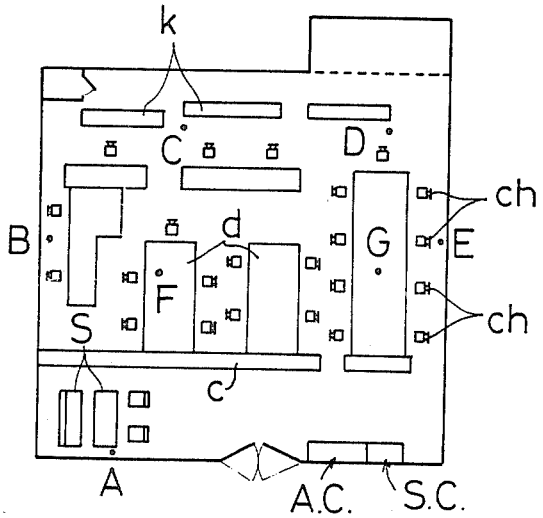
FIG. 5 is a plane view of a room where a room air circulating apparatus according to the invention is employed.
Figure 14A:
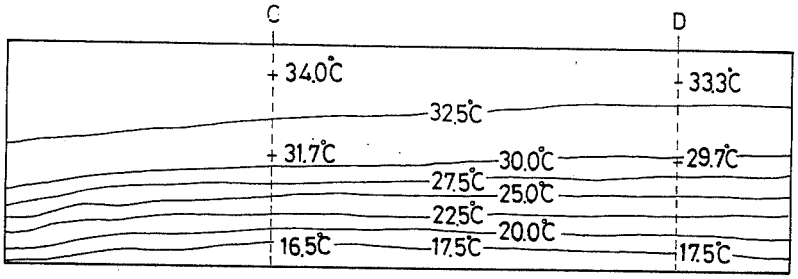
Figure 14B:
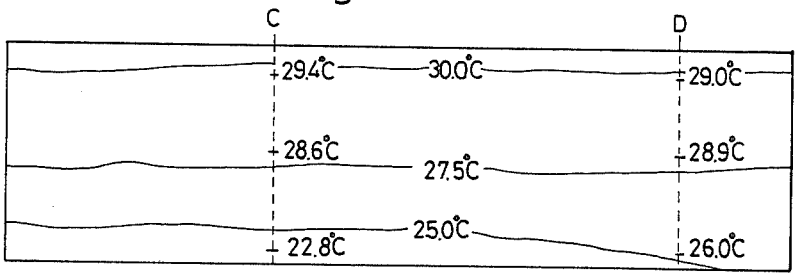
Figure 16A:
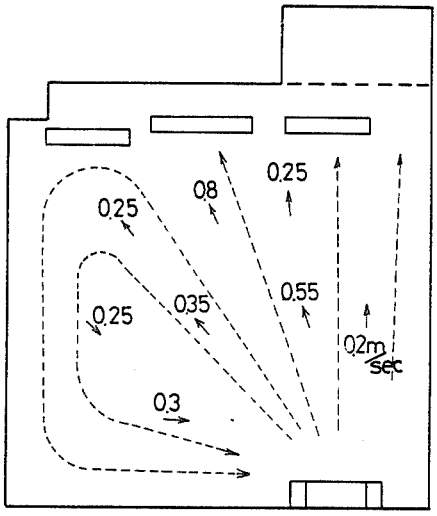
Figure 18:
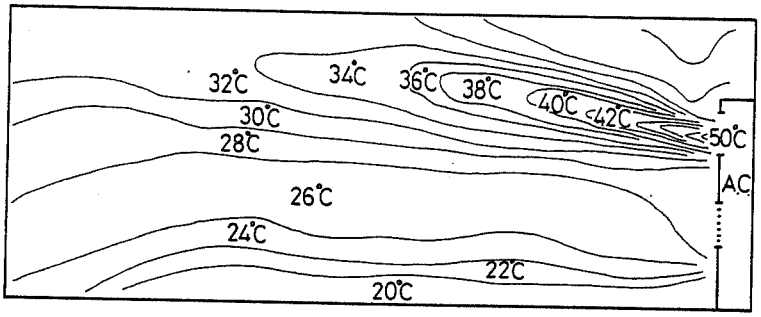
Figure 19:
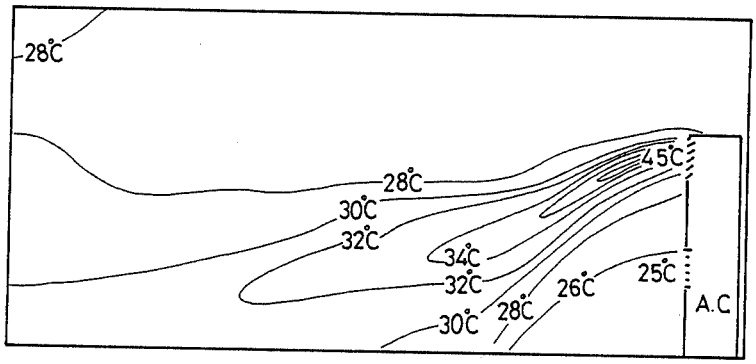
Figure 20:
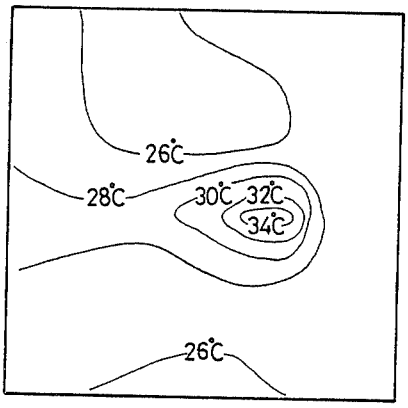
Figure 21:
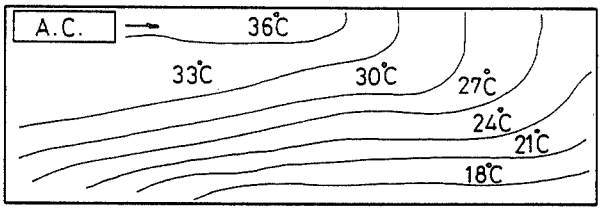
Figure 22:
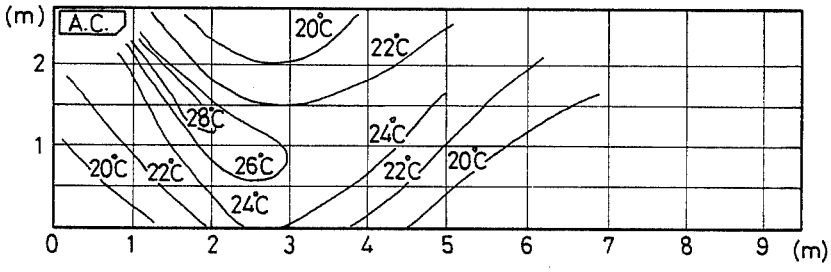
Figure 23:
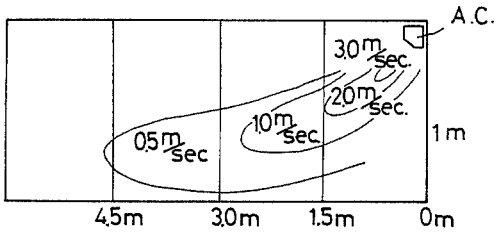
Figure 24A:
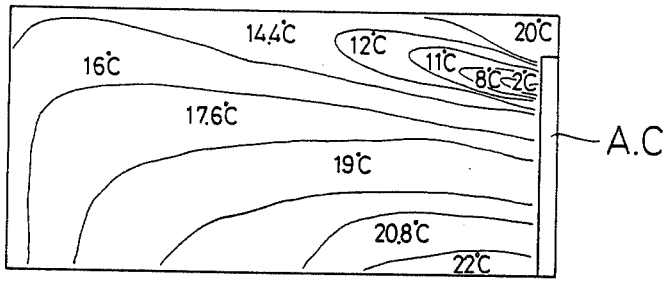
Figure 24B:
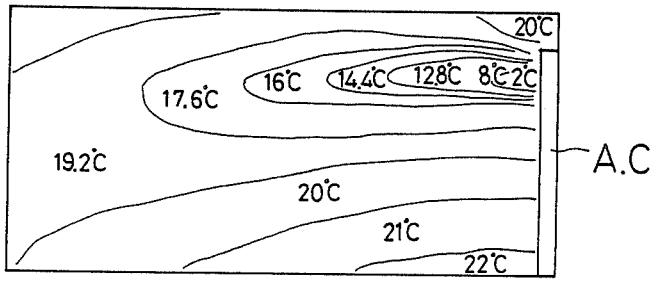
Figure 25:
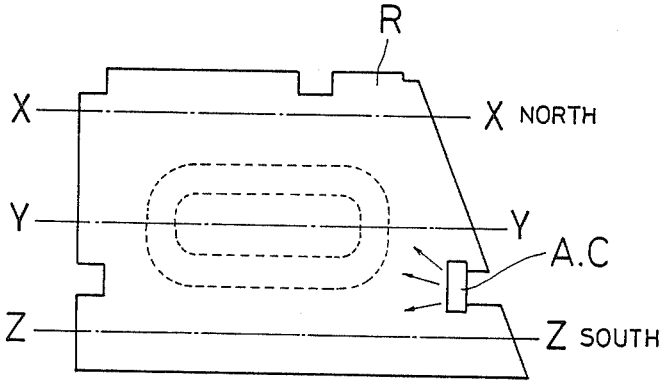
Figure 26A:
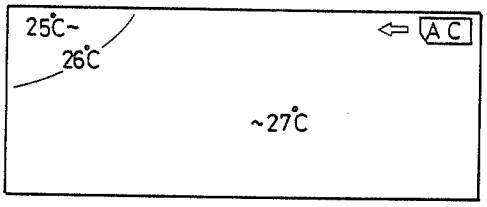
Figure 26B:
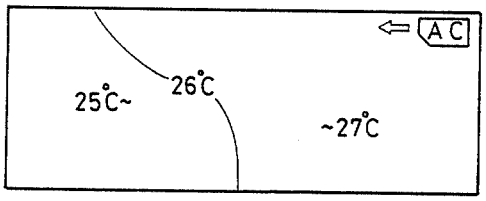
Figure 26C:
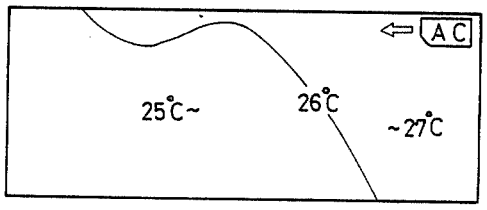
Figure 27:
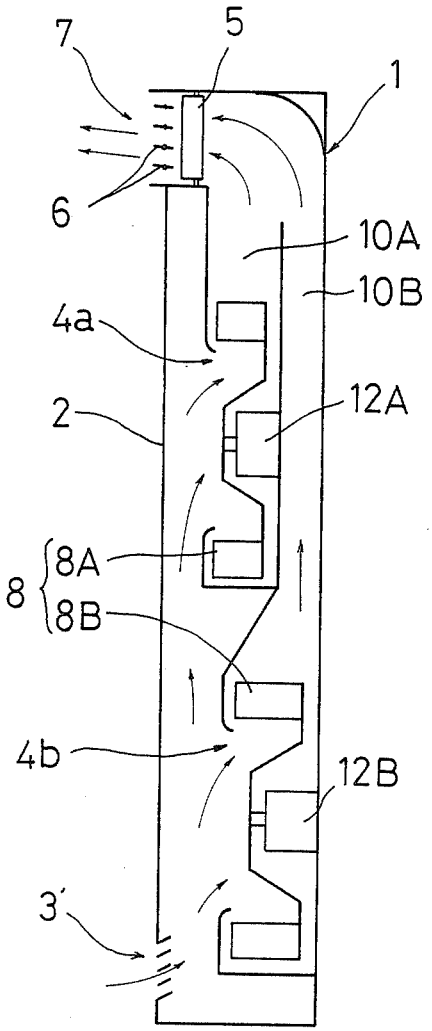
Figure 28:
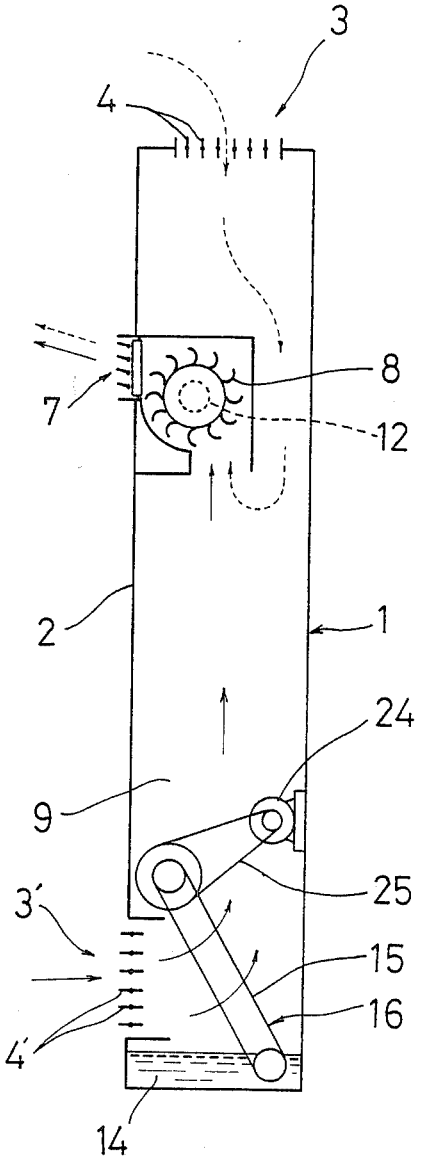
Figure 29:
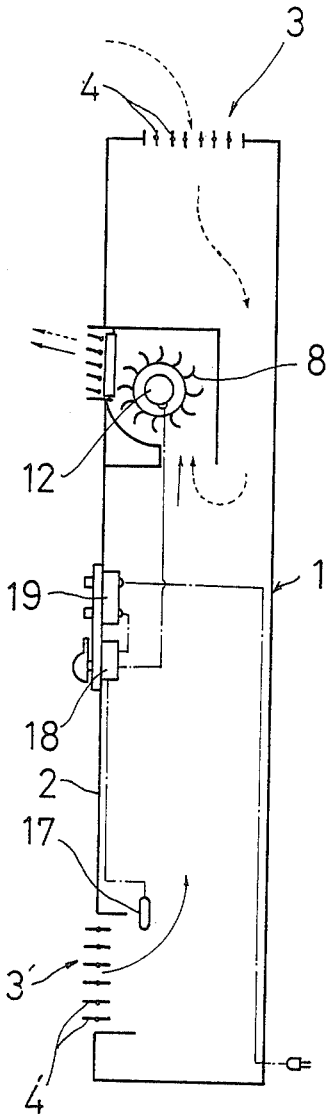
Figure 30:
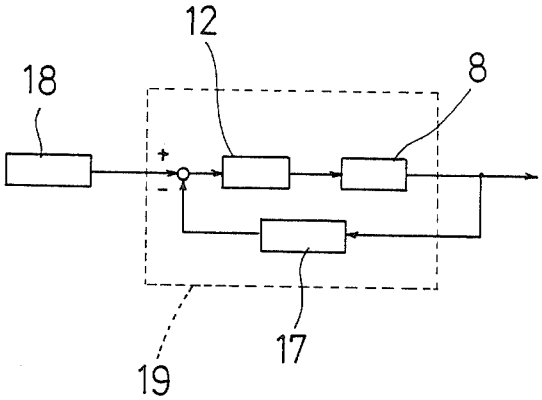
Figure 31:
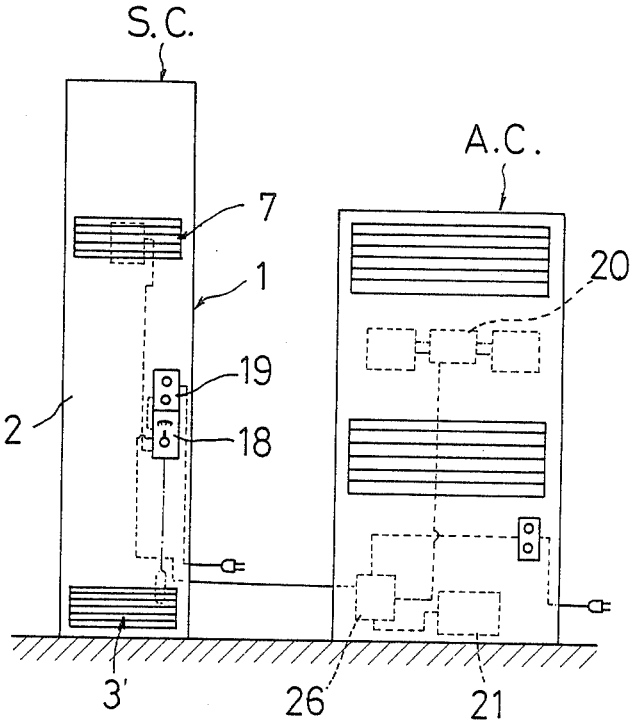
Figure 32:
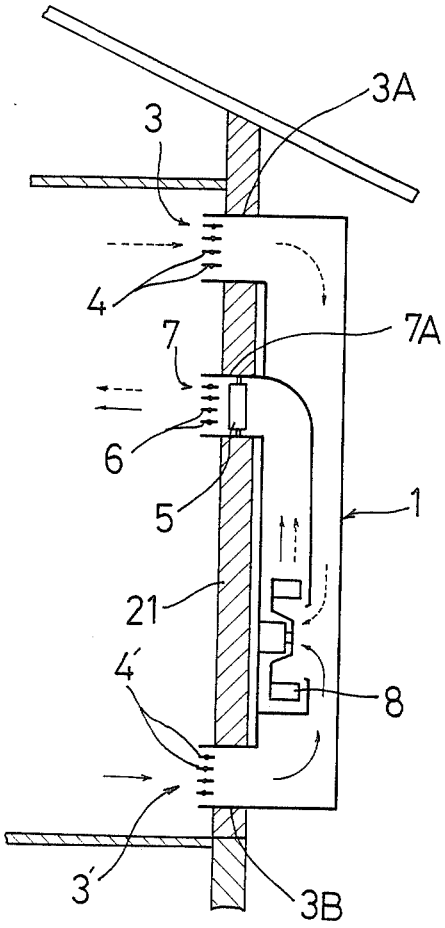
Figure 33:
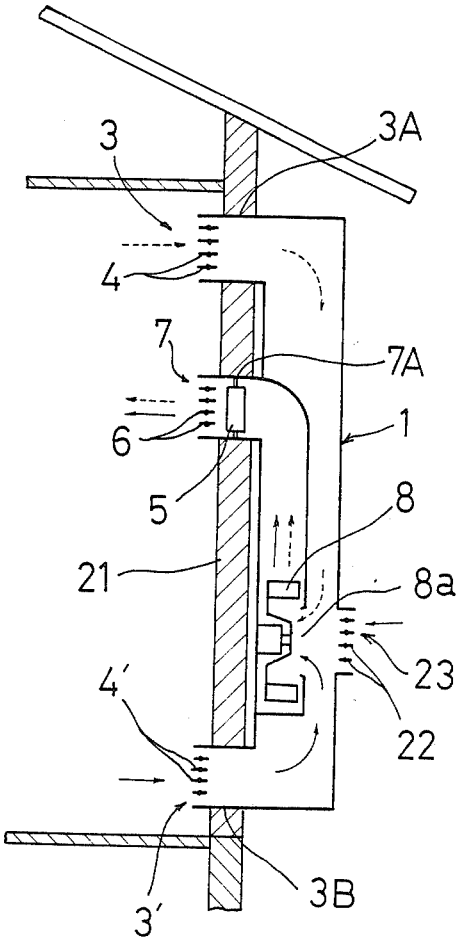

FIGS. 6 to 13 inclusive are graphs showing temperature variation of each parts of the room shown in FIG. 5;

FIGS. 14A, B, and 15A, B are temperature distribution views of a longitudinal section of the room shown FIG. 5;

FIGS. 16A, B and 17A, B are plane views illustrating an air current of the room shown in FIG. 5;

FIGS. 18 to 20 inclusive are temperature distribution views when a floor type of a package air conditioner is solely employed for heating;

FIGS. 21 and 22 are temperature distribution views when a hanging type of a package air conditioner is solely employed for heating;

FIG. 23 is a view of an air current in a condition the same as shown in FIGS. 21 and 22;

FIGS. 24A, B are temperature distribution views when a floor type of a package air conditioner is solely employed for cooling;

FIG. 25 is a plane view of the room shown in FIG. 5 when a hanging type of a package air conditioner is solely used for cooling;

FIGS. 26A, B, and C are temperature distribution views of longitudinal section of the room shown in FIG. 5 for cooling in a condition the same as shown in FIG. 25;

FIGS. 27 to 29 inclusive are all schematic vertical sectional side views according to other embodiments, respectively;

FIG. 30 is a block diagram illustrating the control of the room air circulating apparatus in FIG. 29;

FIG. 31 is a schematic elevational view illustrating the employment of the apparatus shown in FIG. 29; and FIGS. 32 and 33 are schematic vertically sectional side views of employment according to other embodiments, respectively.

DETAILED DESCRIPTION OF THE PREFERRED EMBODIMENT

Preferred embodiments of this invention will be hereinafter described.

Figure 1:
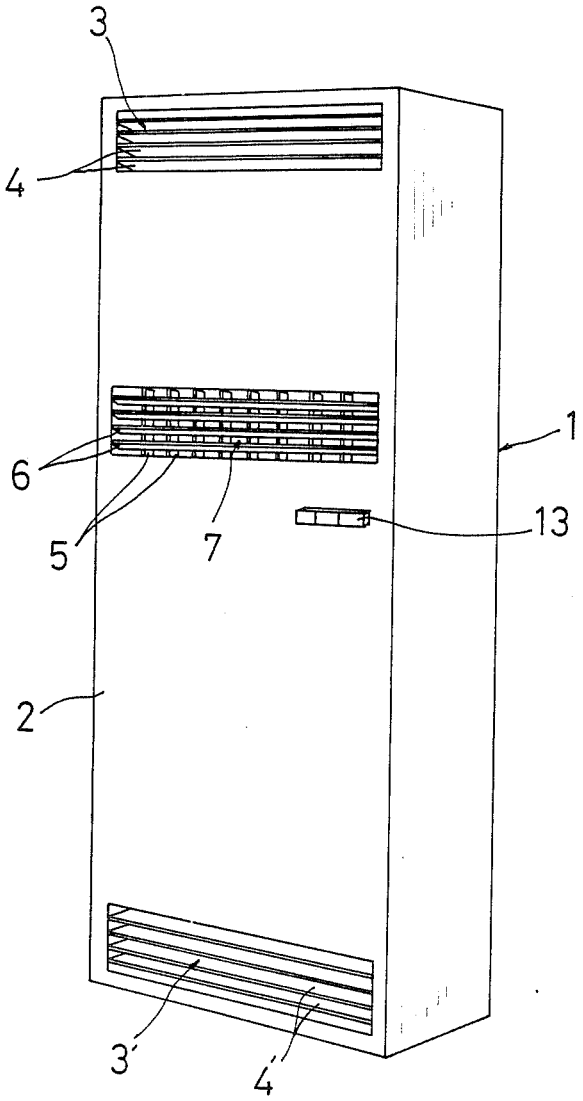
FIG. 1 is a perspective view of a room air circulating apparatus according to this invention.
Figure 2:
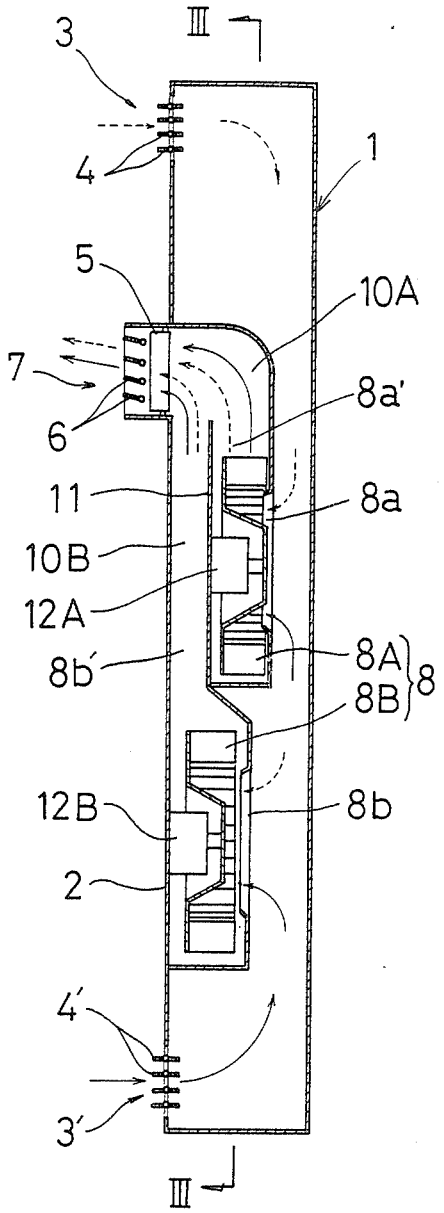
FIG. 2 is a vertical sectional side view.
Figure 3:
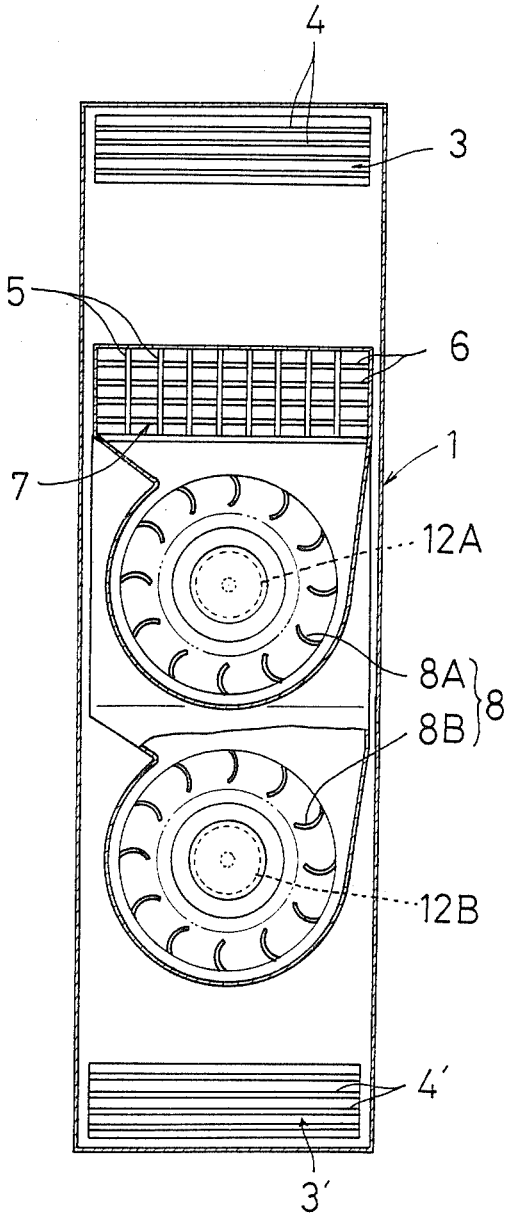
FIG. 3 is a vertical sectional rear elevation taken on line III—III of FIG. 2.

Referring to FIGS. 1 to 3 inclusive, (1) is a hollow case in a box shape approximately 1,900 (mm) in whole height, about 600 (mm) in width, and about 250 (mm) in depth so constructed as to stand by itself on the floor. At the upper and the lower ends of the front plate (2) of the case (1), suction gates (3), (3') are formed which may draw in room air both at the upper and the lower parts near the ceiling and floor, respectively, in a room along a horizontal or nearly a horizontal plane. Rotary dampers (4), (4') are provided with said suction gates (3), (3') at both levels, respectively, which are so constructed as to open or close by means of opening and closing of the rotary dampers (4), (4'). Near the upper end of the front plate (2) of the case (1), a spout gate (7) of room air is formed with blades (5) and (6) for changing air direction with respect to the length and width. A fan (8) for drawing in, and exhausting air is supported in the case (1), the fan comprises two multiblade fans (8A), (8B) supported at the upper and the lower ends of the case (1), respectively. An inlet flue (9) is so formed at the rear of the inside of the case (1) as to connect said two suction gates (3), (3') at both ends and the intake gates (8*a*), (8*b*) at the center of the rotation of said two multiblade fans (8A), (8B). Air outlet gates (10A), (10B) are so formed as to connect spout gates (8*a*'), (8*b*') of said two multiblade fans (8A), (8B) and said spout gate (7) alternately by means of a baffle (11). Electric motors (12A), (12B) for driving said two multiblade fans (8A), (8B) are so connected with a controller as to stop operation automatically and reversibly when the temperature of room air to be drawn in from said gate (3) or (3') reaches the determined value. Since the electric motors are constructed in a very generally matter to omit the description thereof. (13) illustrates an operation switch.

Figure 4A:
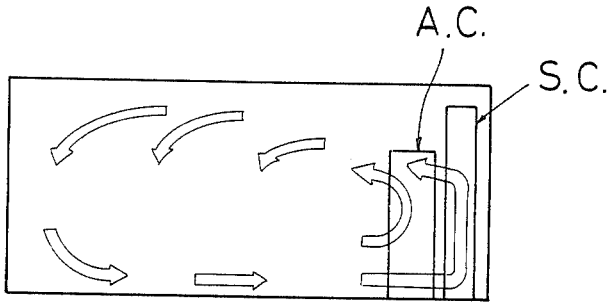
FIG. 4A is a schematic side elevational view illustrating the flow of room air when an apparatus according to the invention is employed for heating.
Figure 4B:
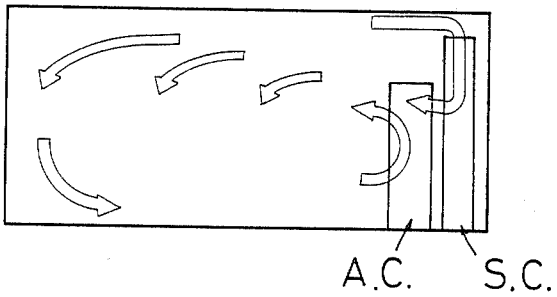
FIG. 4B is a schematic side elevational view illustrating the flow of room air when an apparatus according to the invention is employed for cooling.

A general embodiment of a room air circulating apparatus (shown as S.C. in FIGS. 4A, 4B and 5) being constructed in the manner mentioned above is employed to stand by itself either at the side or the rear of a floor type package air conditioner (shown as A.C. in Figures according to FIGS. 4A, B) in either case of heating or cooling.

In a case of heating the multibade fans (8A), (8B) are operated in synchronism with a package air conditioner (A.C.) to be employed. With the upper end damper (4) closed and the lower end damper (4') open, room air at a lower zone than the inlet zone of the package air conditioner (A.C) is drawn in from the suction gate (3') along a horizontal or nearly a horizontal plane, and the inlet room air is blown to a room from said spout gate (7) slightly upward according to the solid line shown in FIG. 2 and double lines in FIG. 4A. In case of cooling, by means of the employment in the same manner as mentioned above with the upper end damper (4) open and the lower end damper (4') closed, room air at the higher zone than the cool air exhaust zone from the package air conditioner (A.C.) is drawn in from the suction gate (3) along a horizontal or nearly a horizontal plane, and the drawn in room air is exhausted to a room from said outlet gate (7) slightly upward according to broken lines in FIG. 2 and double lines in FIG. 4B.

Both in heating and cooling cases, by means of setting the angle at which warm or cool air is exhausted from the package air conditioner (A.C.), the mixed air to be generated by mixture of the warm or cool air exhausted from the package air conditioner (A.C.) and the air blown from the room air circulating apparatus can be largely circulated in a room, actually heating or cooling with little temperature variation.

Another embodiment will be hereinafter described in the manner to be employed together with stoves and the like mentioned before at the time of heating, though figures illustrating the same are not shown. In this embodiment, the mixed air to be generated by mixture of inlet cool air near the floor to be blown into stagnant hot air near the ceiling can be largely circulated in a room in the same manner as mentioned above, producing a temperature increase in a whole room.

A further embodiment will be hereinafter described by means of the sole employment of the circulating apparatus in the spring and the autumn when there is no need of heating and cooling, thereby generating a proper amount of air flow around a human body so as to give a pleasant feeling.

In the modified embodiment, two multiblade fans (8A) (8B) used at both ends as a fan (8) for drawing in and exhausting air to provide such advantages as to narrow the width of the device in the direction of the shaft line of the fan compared with the use of a single fan used for supplying the necessary quantity of drawn in or exhausted air (the quantity of the air to be blown). Thereby a thinner and smaller apparatus as a whole is constructed leading to preventing the increase of the occupancy space due to the joint employment with a conventional package air conditioner. Referring to FIG. 27, illustrating a modified embodiment using two fans, it may be so contructed that the room air may be drawn in from the suction gate (3') at the lower end and exhausted into a room from the spout gate (7) by omitting the suction gate (3) at the upper end. This embodiment is particularly aimed at a high ceiling room, where hot air stagnation at a higher level than the dwelling zone does not influence a cooling effect very much so that air is left without being circulated.

The third embodiment to be hereinafter described structually differentiates from the first embodiment as described hereinafter, but it is almost identical in its function. The explanation of the identical parts of the two embodiments are omitted by and are shown by identical symbols.

Referring to FIG. 28, the third embodiment differentiates from the first and second embodiments in that a single fan (8) for drawn in and exhausting air is equipped inside the case (1) at the immediate rear of the spout gate (7). A humidifying device (16) which is surrounded by an endless belt made of a waterproof material with unrestricted driving rotation through a motor (24) and a transmission belt (25) at the position between a water tank (14) in the base of said case (1) is so constructed and includes an intake flue (9) for the air from said suction gate (3') at the lower end to the fan (8).

The third embodiment is employed through almost the same circulation illustrated by solid and broken lines at the time of heating and cooling as the operation of the first and second embodiment. Flowing through the endless belt (15), the room air drawn in from said gate (3') is humidified by absorbing moisture kept at the endless belt (15) then additionally the humidified air is exhausted into a room and diffused by the circulation of the mixed air to present such advantages as to maintain the humidity of the room appropriately and to produce a more pleasant heating effect.

Referring to FIGS. 29 and 30 illustrating the fourth embodiment presenting almost the same construction as the third embodiment, comprises a sensor (17) for detecting the temperature of the room air drawn in from the suction gate (3') and a controller (19) for automatically controlling the revolving speed of a single fan (8) and via the electric motor (12) corresponding to the temperature detected by the sensor (17) so that the temperature of the room air can be maintained in the determined range to be set by a device (18) for determining temperature. According to the fourth embodiment, pleasant heating by uniform and suitable room temperature is expected, while electric power use can be reduced by means of eliminating unnecessary room air circulation.

Referring to FIG. 31, illustrating the fourth embodiment, the floor type of package air conditioner (A.C.) to be employed jointly comprises both a fan motor (20) and a compressor (21) to be electrically connected with said controller (19) of the apparatus (S.C.) so that this apparatus (S.C.) and the package air conditioner are controlled synchronously, by which the room temperature can be more effectively uniform. An electromagnet control is shown at (26).

Referring to FIG. 32 illustrating the fifth embodiment, a hollow case in a box shape is so constructed as to be fixed outside of a wall (21) of a building outdoors therefore pipes (3A), (3'), and (7A) are extended through the wall (21) thereby permitting said suction gates (3), (3') of both ends and said spout gate (7) to be open into a room within the building. Though the embodiment of a single fan (8) is shown, two fans can be employed.

The fifth embodiment presents practical effects by offsetting such disadvantages as deteriorating the space utilization rate or detracting from the fine appearance of the room by means of the case (1) to be employed oudoors. In the fifth embodiment, a gate (23) for drawing in outside air is provided with a damper (22) for opening and closing the gate. The gate (22) can be formed near the position of the inlet of the fan (8) on the rear wall of the case (1) as shown in FIG. 33. In this case, by means of taking in fresh air at the time of air circulation when the necessity rises, ventilation is executed at the same time which permits the apparatus to be effectively employed for the exclusive use of ventilation in spring and autumn.

In the fifth embodiment, the case (1) can be so constructed as to stand by itself at a veranda or on the ground.

While different embodiments of this invention have been described, the invention is not restricted to the embodiments shown.

(1) Method of use of the system.

Referring to FIG. 5 in a room of plain shape about 10.5 m×10.5 m×2.9 m in length×width ×height respectively (floor area 110.25 m Δ, capacity 319.7 m') where office desks (d), counters (c), cabinets (k), a set of tables and chairs for a receptionist (s), and chairs (ch) are arranged as illustrated, room temperatures at the points of A to G inclusive are measured in a condition of actual business performances.

b. specification of a package air conditioner is as follows:

total input: 3.3/10KW
compressor: 3.3 KW
blowing apparatus: two Sirrocco fans
air quantity: 62/70' m/minute
height: 1,335, depth: 505, width: 1,300
height of suction gate: 800
height of spout gate: 1,800 (mm)

c. the points of temperature recording recorder to be employed: digital temperature recorder Model 3874 manufactured by Yokogawa Electric Works, Ltd. points to be measured

| NO. | point to be measured |
|---|---|
| 00 | outside air |
| 01 | top of A (2.5 m higher than the floor level) |
| 02 | middle of A (1.5 m higher than the floor level) |
| 03 | bottom of A (0.2 m higher than the floor level) |
| 04 | top of A (2.5 m higher than the floor level) |
| 05 | middle of B (1.5 m higher than the floor level) |
| 06 | bottom of B (0.2 m higher than the floor level) |
| 07 | top of C (2.5 m higher than the floor level) |
| 08 | middle of C (1.5 m higher than the floor level) |
| 09 | bottom of C (0.2 m higher than the floor level) |
| 10 | top of D (2.5 m higher than the floor level) |
| 11 | middle of D (1.5 m higher than the floor level) |
| 12 | bottom of D (0.2 m higher than the floor level) |
| 13 | top of E (2.5 m higher than the floor level) |
| 14 | middle of E (1.5 m higher than the floor level) |
| 15 | bottom of E (0.2 m higher than the floor level) |
| 16 | middle of F (1.5 m higher than the floor level) |
| 17 | bottom of F (0.2 m higher than the floor level) |
| 18 | middle of G (1.5 m higher than the floor level) |

-continued

| NO. | point to be measured |
|---|---|
| 19 | bottom of G (0.2 m higher than the floor level) |
| 20 | spout gate of the apparatus (2.0 m higher than the floor level) |
| 21 | spout gate of the air conditioner (1.3 m higher than the floor level) |
| 22 | suction gate of the air conditioner (0.3 m higher than the floor level) |
| 23 | spout gate of the apparatus (0.3 m higher than the floor level) |

methods of record measurement

8:20–11:50 The air conditioner is solely used.

11:53–18:00 The apparatus is used jointly.

a. Measurement of the velocity.

Figure 6:
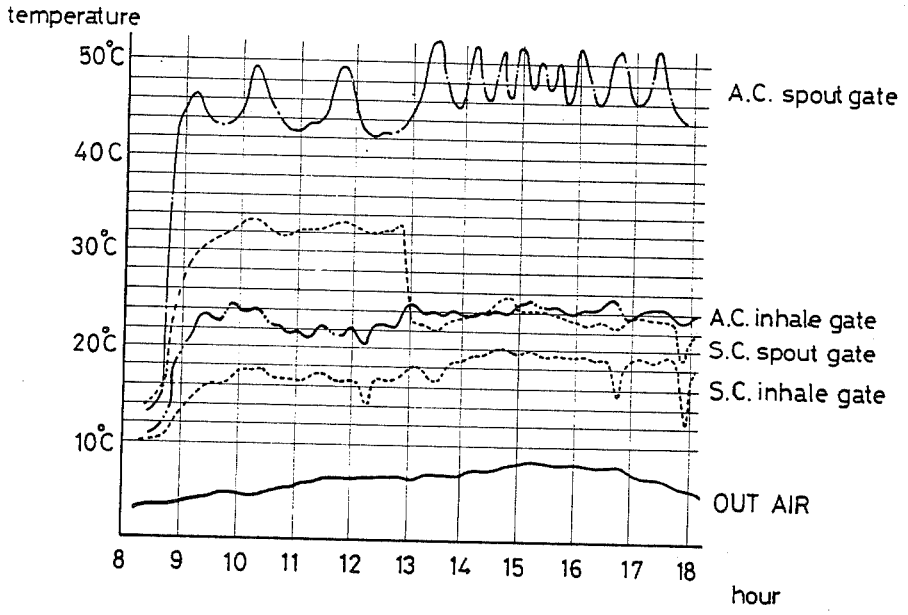
Figure 7:
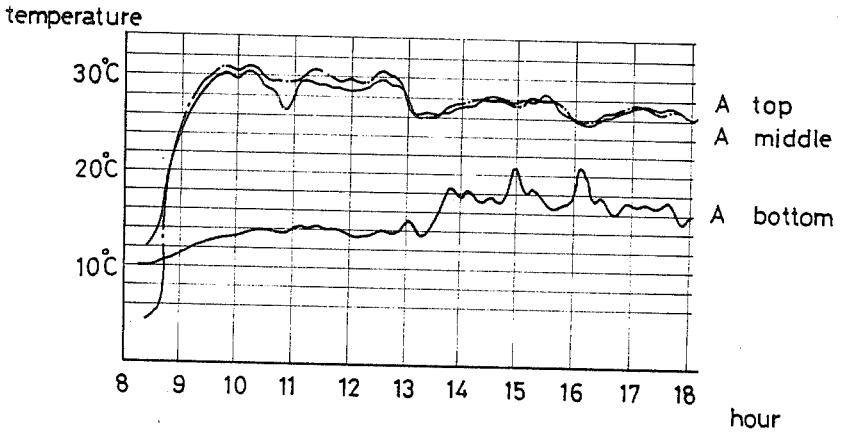
Figure 8:
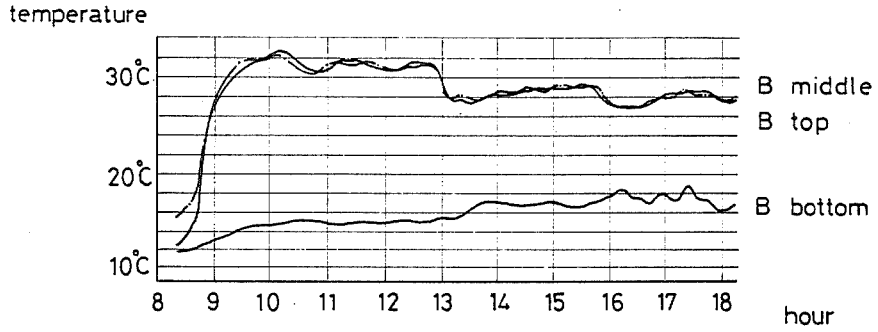
Figure 9:
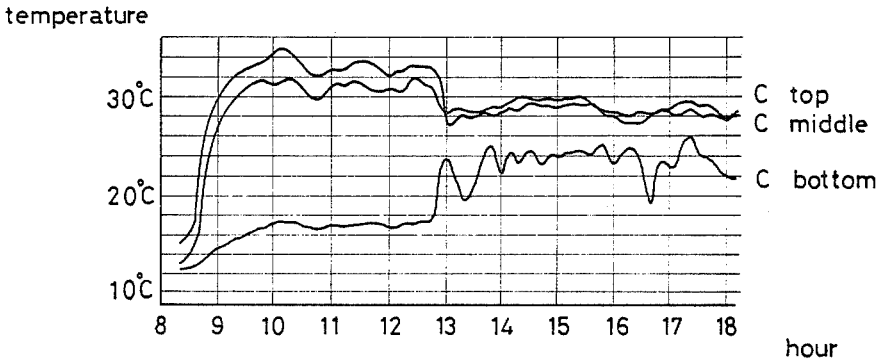
Figure 10:
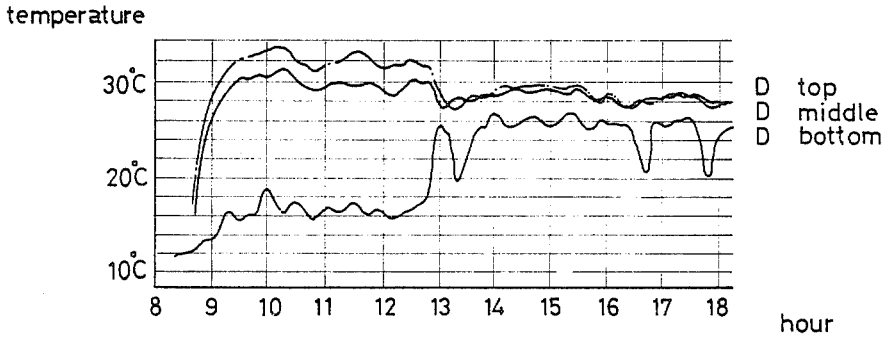
Figure 11:
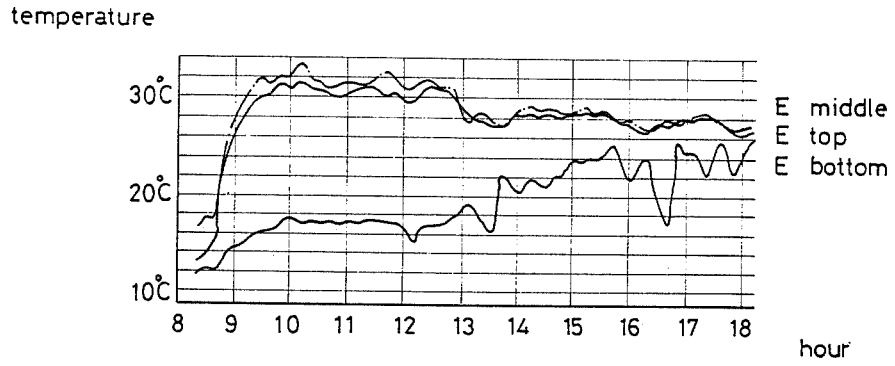
Figure 12:
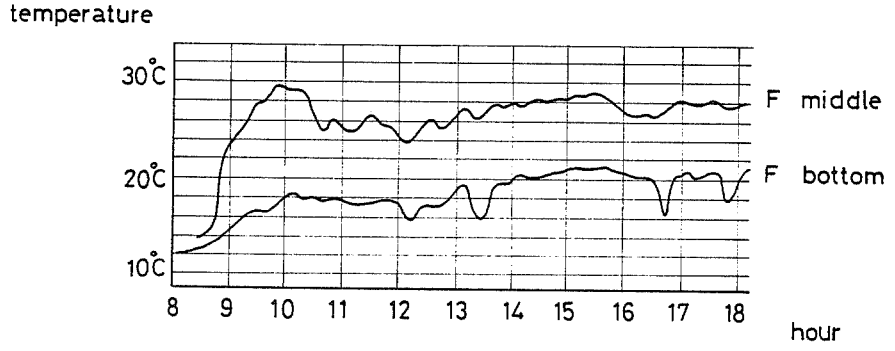
Figure 13:
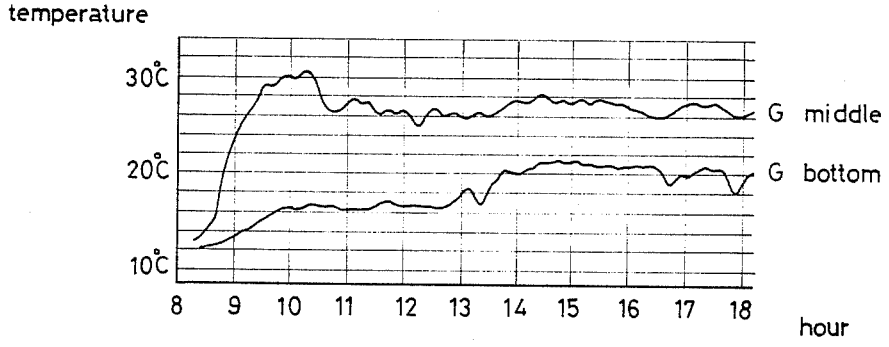

The velocity and the direction of air at the points 00 to 21 inclusive in the above Table I (2) Result of the Experiment a. FIGS. 7 to 13 inclusive show the room temperature variation at the measured points A to G, and FIG. 6 shows the temperature variation of outside air, the suction gate and the spout gate of the air conditioner (A.C.) and the apparatus (S.C.) respectively, resulting hereinafter;

Since after the joint employment, the temperature at the suction gate of the air conditioner drops about 10° C., and slight increase as a whole after fluctuation is shown at the spout gate.

Figure 15A:
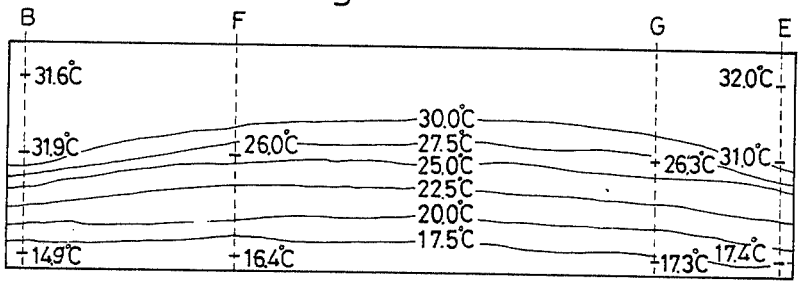
Figure 15B:
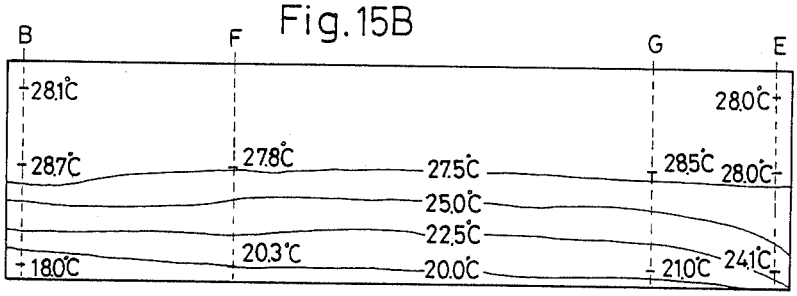
Figure 16B:
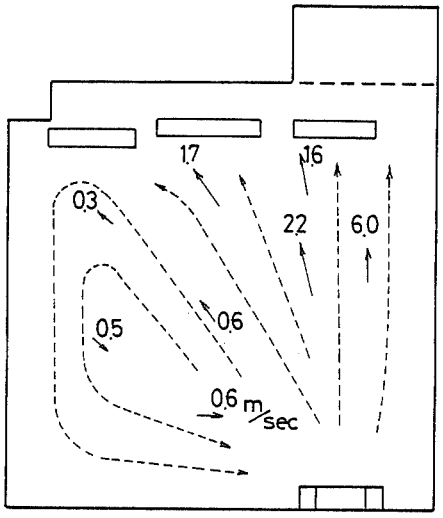
Figure 17A:
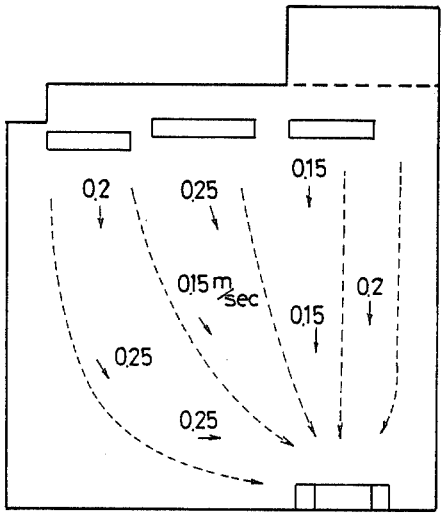
Figure 17B:
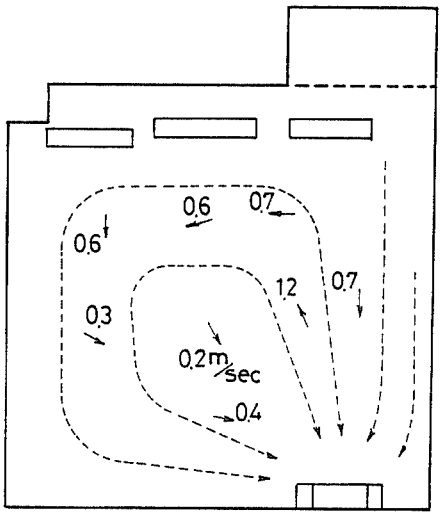

Since after the joint employment, the temperature at the high and middle part of the points A to D inclusive reduces about 2° C. to 4° C. while the temperature at the low part increases 3° C. to 9° C. At the points F and G near the air conditioner, the temperature variation at the middle part is modest and about 4° C. increase is shown at the low part. The remarkable decrease and increase of temperature are shown at the top part and the bottom part respectively at the points A, B, C, D, which are farther from the air conditioner.

b. Referring to FIGS. 14A, B of views of sectional temperature distribution at the points C–D, and referring to FIGS. 15A, B of views of sectional temperature distribution at the measured points B–F–G–D, when the air conditioner is solely employed and the apparatus is jointly used respectively, the result thereof is that room temperature near the floor at the almost whole frontage is 20° C. or higher in case of joint employment with the increase of about 5° C. to 10° C., while the temperature near the ceiling drops about 5° C. compared with the sole employment.

c. Referring to FIGS. 16A and 17A illustrating the currents at 1.5 m and 2.5 m higher than the floor level respectively when the air conditioner is solely used, while referring to FIGS. 16B and 17B illustrating the current respectively of the above mentioned heights when the apparatus is jointly employed, which results in hereinafter;

The velocity at the time of joint employment is twice as much as the case of sole employment, resulting in the circulation of the air in large quantity.

The current at the left of the position of the air conditioner largely moves counterclockwise, while at the right the air directed to the ceiling circulated with large velocity, which permits cool air in large quantity at the lower level to be drawn into the suction gate at the lower end of the apparatus.

Though the velocity near the ceiling is high, at the level where the air touches a human body the velocity is relatively low and gives little impact by the blast air hitting directly.

As the results of the operation have been described by a to c herein, the effect of presenting the little temperature variation between the upper and the lower levels of a room and a very pleasant heated space according to this invention is sufficiently supported.

In case of cooling, when the circulation is generated by means of drawing in and mixing the warm air near the ceiling with the blast air, it is clearly understood that room temperature can be effectively uniform almost the same as the case of heating, although the detailed description of the results of the operation is herein omitted.

I claim:

1. A movable free standing air circulating apparatus comprising upper and lower ends formed by an elongated rectangular hollow case (1) having top and bottom walls, front, rear and side walls, at least one opening (3,3') and a spout gate (7) in said front wall, said at least one opening (3,3') in said front wall being arranged to include an adjustable rotary air damping means (4,4') to control a quantity of air flow into said hollow case, said spout gate (7) in said front wall provided with plural sets of air flow directing blades (5,6), air flow baffling means in said hollow case arranged to cooperate with said air flow directing blades (5,6), said air flow baffling means (11) including means arranged to cooperate with said front wall and including further casing means adapted to support at least one dependently disposed blower means (8A, 8B), said blower means adapted to draw in air through said at least one opening in said front wall which air exits from said spout gate (7) in said hollow casing subsequent to passage through said air flow baffling means (11) and said at least one dependently disposed blower means (8A, 8B).

2. A movable free standing air circulating apparatus as set forth in claim 1, in which said rectangular hollow casing includes lower and upper openings on opposite sides of said at least one blower means.

3. A movable free standing air circulating apparatus as set forth in claim 2, which includes two spaced blower means between said lower and upper openings.

4. A movable free standing air circulating apparatus as set forth in claim 2 wherein said lower opening is in said front wall and said upper opening is in said front wall.

5. A movable free standing air circulating apparatus as set forth in claim 3 wherein said lower opening is in said front wall and said upper opening is in said front wall.

6. A movable free standing air circulating apparatus as set forth in claim 2 wherein said lower opening is in said front wall and said upper opening is in said top wall.

7. A movable free standing air circulating apparatus as set forth in claim 3 wherein said lower opening is in said front wall and said upper opening is in said top wall.

8. A movable free standing air circulating apparatus as set forth in claim 3 which includes a humidifying device in said lower end of said case which includes a water tank below said lower openings.

9. A movable free standing air circulating apparatus as set forth in claim 1 which includes at least one sensor for detecting temperature of air drawn in through said at least one opening and a controller for controlling operation of said blower means in accordance with the temperature of the air drawn in whereby the temperature of the air can be maintained at a desired temperature range.

10. A movable free standing air circulating apparatus as set forth in claim 2 which includes an air inlet opening in said rear wall which includes an adjustable rotary damping means.

11. A movable free standing air circulating apparatus as set forth in claim 1 which includes in combination an air conditioner-heater for cooling or heating a room in which said air circulating device is free standing.

12. A claim as set forth in claim 11 which includes control means for simultaneous as well as independent operation of said air circulating means and said air conditioner- heater.

13. An air circulating apparatus as claimed in claim 2 in which said air circulator is secured to an outside wall of a room with said lower and upper openings and said spout gate extending through said outside wall into said room.

14. An air circulating apparatus as set forth in claim 13 in which said rear wall includes an air inlet opening which includes adjustable rotary damping means.

* * * * *